US005456504A

United States Patent [19]

Brillant

[11] Patent Number: 5,456,504

[45] Date of Patent: Oct. 10, 1995

[54] LOCKING AND UNLOCKING APPARATUS FOR ACCESS DOOR ON A PASSENGER RAILWAY VEHICLE

[75] Inventor: Daniel Brillant, Greer, S.C.

[73] Assignee: Westinghouse Air Brake Company, Wilmerding, Pa.

[21] Appl. No.: 237,654

[22] Filed: May 4, 1994

[51] Int. Cl.[6] ..... E05F 11/34

[52] U.S. Cl. ..... 292/63; 292/DIG. 26

[58] Field of Search ..... 292/168, 201, 292/171, DIG. 4, DIG. 32, DIG. 46, 63, 64, 66; 49/449

[56] References Cited

U.S. PATENT DOCUMENTS

| | | | |
|---|---|---|---|
| 1,468,019 | 9/1923 | Guerrant | 49/449 |
| 2,389,056 | 11/1945 | Jamison, Jr. | 292/341.17 |
| 2,604,343 | 7/1952 | Fredholm | 292/340 |
| 2,743,953 | 5/1956 | Marra et al. | 292/340 |
| 3,314,706 | 4/1967 | Carlson et al. | 49/449 |
| 3,318,048 | 5/1967 | Odend'hal | 49/449 |
| 3,722,937 | 3/1973 | Stoecki | 292/340 |
| 4,198,786 | 4/1980 | Monot | 49/449 |

*Primary Examiner*—Peter M. Cuomo
*Assistant Examiner*—Monica E. Millner
*Attorney, Agent, or Firm*—James O. Ray, Jr.

[57] ABSTRACT

An apparatus for mechanically locking and unlocking a passenger access door panel on a railway vehicle which includes a locking lever arm, one end of which is pivotally secured to a movable door panel and having a roller secured at the opposite end, and having a biasing means to pivotally bias the roller against a locking support structure secured to a structure adjacent to the movable door panel when such door panel is moving into the closed position. The locking support structure has a first rail surface at an inclined angle to the door panel and a second rail surface which is substantially perpendicular to the door panel and is positioned so that the roller on the locking lever arm will roll along the first inclined rail surface when the door panel is moving into the closed position, and such that when the door panel reaches a fully closed position, the roller will move beyond such first inclined rail surface and be biased to move against the perpendicular rail surface to thereby lock the door panel in the fully closed position. The apparatus further includes an unlatching lever assembly that will pivot the locking lever arm and roller away from the perpendicular rail surface in response to automatic controls activated by a door opening mechanism, or in response to a manual controls.

14 Claims, 5 Drawing Sheets

LOCKING AND UNLOCKING APPARATUS FOR ACCESS DOOR ON A PASSENGER RAILWAY VEHICLE

FIELD OF THE INVENTION

The present invention relates, in general, to a locking and unlocking apparatus for a passenger transit type railway vehicle and, more particularly, this invention relates to a simple and reliable apparatus for mechanically locking and unlocking the access doors of such passenger transit type railway vehicle which allows for automatic locking and unlocking during normal operation, and which will maintain the access door in a mechanically locked condition in the event of a pressure failure in the door activating system, and yet permits quick and easy manual unlocking in the event of an emergency.

BACKGROUND OF THE INVENTION

It is generally well known in the art, that the access doors on passenger transit railway vehicles, such as subway cars and the like, are provided with an automatic opening and closing mechanism which is controlled by the operator of such vehicle. It is also well known that such access doors are normally provided with an automatic locking mechanism that will lock such access doors in the closed position when the vehicle is in motion to safeguard the passengers during normal operation. These access doors, however, must also be provided with a mechanism that will permit an override or by-passing of the automatic locking mechanism to enable the operator or a passenger to manually open such access doors in the event of an emergency.

Typically, such an access door or pair of doors are operated by either a hydraulic or pneumatic cylinder which is connected to a linkage mechanism adapted to open and close the door or doors in response to the reciprocating action of the hydraulic or pneumatic cylinder rod. In most operating situations, the doors are locked in place in the closed position by maintaining a positive pressure within the hydraulic or pneumatic cylinders while the doors are in the closed position. When the doors are automatically opened by the vehicle operator, however, the hydraulic or pneumatic cylinders are activated in the opposite direction, thereby releasing the positive pressure within the cylinder which maintains the access doors in their locked position.

The emergency release device, on the other hand, is usually some type of mechanical system that will release an access door from the linkage system driven by the hydraulic or pneumatic cylinder, thereby permitting a passenger, for example, to force such access door open even though a positive pressure is being maintained within the hydraulic or pneumatic cylinder. In the event of a pressure loss in the hydraulic or pneumatic cylinder system, however, the access doors will not be locked in the closed position, thereby creating a hazardous condition.

SUMMARY OF THE INVENTION

The present invention is predicated upon a new and unique positive, mechanical locking system that can be used in combination with conventional door operating systems that does not depend upon a positive pressure within the hydraulic or pneumatic cylinder to lock an access door in the closed position, but rather locks the door in the closed position mechanically. While the door locking system of this invention can be effectively utilized in combination with such conventional door operating system which depends on a positive pressure being maintained in the hydraulic or pneumatic system to keep the doors locked, thereby providing a double locking system, the mechanical system of the instant invention will further provide a positive lock in the event of a loss of hydraulic or pneumatic pressure. Additionally, the system of this invention can be utilized as the sole access door locking system if so chosen. Accordingly, the apparatus of this invention will keep the doors mechanically locked in the closed position whether or not additional locking is provided with a positive pressure in the hydraulic or pneumatic cylinders, and whether or not there is a loss of pressure in the hydraulic or pneumatic system.

As is obviously necessary, the system of this invention is further provided with a simple unlocking mechanism which will automatically disengage or unlatch the mechanical locking apparatus when the door opening mechanism is activated to open the access door, and is further provided with a system which enables the manual disengaging or unlatching of the mechanical locking apparatus so that the access doors can be opened manually in an emergency situation.

In its basic form, the apparatus of this invention-utilizes a spring biased locking lever arm which is pivotally secured to a movable access door panel. A roller, rotatably secured to the locking lever arm at an end opposite the pivotal attachment, is positioned so that it will engage a ramp rail structure secured to a door frame structure adjacent the moveable access door panel when such door panel is moving into a closed position. The ramp rail structure is provided with two intersecting guide rail surfaces, namely, a first rail surface at an inclined angle to the moveable door panel, and a second rail surface disposed substantially perpendicular to the door panel such that the first and second rail surfaces intersect at an angle of less than about 90° to form a rail corner. The pivotal locking lever arm and the ramp rail structure are relatively positioned so that when the access door panel is being moved into the closed position, the roller on the locking lever arm will roll along the first; i.e., inclined, rail surface of such ramp rail structure, and when such access door panel reaches a fully closed position, the roller will move beyond the intersection of the two rail surfaces and be biased to move perpendicular to the access door panel and engage the rail surface perpendicular to the door panel to thereby lock such door panel in the fully closed position.

In combination with the above-described apparatus, an automatic unlocking means, actuated by a door opening means, is also included. The automatic unlocking means of this invention will push the roller from engagement with the second, or perpendicular rail surface of the ramp rail structure so that such access door panel can be moved towards an open position, and upon the subsequent release of the automatic unlocking means, the roller will be caused to engage the first, inclined rail surface of such ramp rail structure so that such access door panel can be moved to a fully open position. For emergency situations, there is a means provided which enables manual activation of the above-described unlocking means.

OBJECTS OF THE INVENTION

It is, therefore, one of the primary objects of the present invention to provide a simple, reliable, low cost and easy to operate, mechanical means for locking an access door on a railway type passenger transit vehicle which is independent of any hydraulic or pneumatic system for opening and, closing the access door so that such an access door will be maintained in the closed and locked position in the event of a pressure failure in the hydraulic or pneumatic system.

Another object of the present invention is to provide a mechanical means for locking an access door on a railway passenger transit vehicle which is not sensitive to vertical and longitudinal acceleration.

A further object of the present invention is to provide a mechanical means for locking an access door on a railway passenger transit vehicle which is simple and reliable and can be located or relocated in different positions depending on the space available.

An additional object of the present invention is to provide a mechanical means for locking an access door on a railway passenger transit vehicle which is simple and reliable and can be easily incorporated with different door opening and closing mechanisms and different types of access doors.

A still further object of the present invention is to provide a mechanical means for locking an access door on a railway passenger transit vehicle which can be manually unlocked with relatively good efficiency.

In addition to the above-described objects and advantages of the locking and unlocking apparatus of this invention, various other objects and advantages of the present invention will become more readily apparent to those persons who are skilled in the same and related arts, from the following more detailed description of the invention, particularly, when such description is taken in conjunction with the attached drawing figures and with the appended claims.

DESCRIPTION OF A PREFERRED EMBODIMENT OF THE INVENTION

Figure 1:
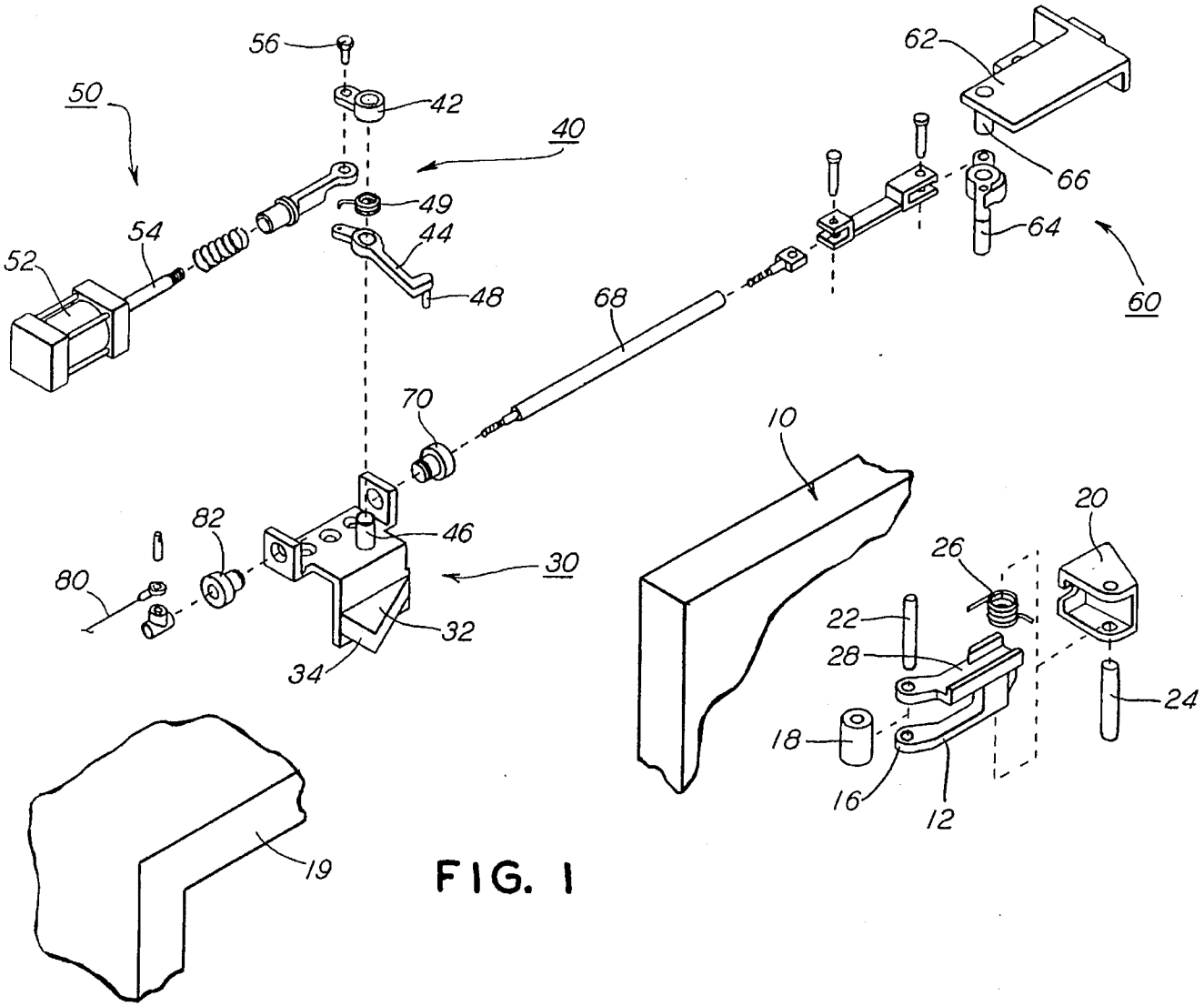
FIG. 1 is an exploded isometric view of the apparatus of one presently preferred embodiment of this invention for locking a single sliding access door panel in a fully closed position.

Prior to proceeding with a more detailed description of the access door locking and unlocking apparatus of this invention, it should be noted that throughout the several views illustrated in the attached drawings, identical components which have associated therewith identical functions have been identified with identical reference numerals for the sake of clarity.

Referring now to the several drawings, illustrated therein is one preferred embodiment of an access door locking and unlocking apparatus of this invention generally illustrating a door panel 10, of the type commonly used on passenger transit type railway vehicles whereby a single, one piece door panel 10 is mounted to a roller assembly (not shown) and mechanically linked to a door opening and closing apparatus (not shown), such as a hydraulic or pneumatic cylinder with appropriate linkage, adapted to slide the single door panel 10 back and forth from a closed position across a door portal (not shown) to an open position not across such door portal 19. It is well known that other types of access door panels are commonly utilized, such as double sliding doors as well as single and double folding doors.

While the embodiment of this invention described and illustrated here is shown as applied to a simple, one piece single sliding door, it will become apparent that the door locking and unlocking apparatus of this invention can be incorporated with doors of the other types noted above, as will be subsequently discussed.

Reference to FIG. 1 illustrates a single, one piece sliding access door panel 10, to which a locking lever arm 12, is secured, preferably near the upper edge of such access door panel 10, and also preferably in a location where it will be shielded from access by vehicle passengers, such as behind an overhanging door frame structure (not shown). The locking lever arm 12 has a first end 14 pivotally secured to a lever arm mounting base 20, and a second end 16 having a roller 18, rollably secured thereto with pin 22, with the axis of roller 18 vertically disposed and parallel to the plane surface of access door panel 10. The first end 14 of locking lever arm 12 is pivotally secured to lever arm mounting base 20 with a pin member 24 such that locking lever arm 12 is able to pivot on pin 24 in a plane perpendicular to access door panel 10, and is biased by torsion spring 26 to bias the pivotal motion of locking lever arm 12 in a clock-wise direction (as viewed from the top), which is intended to bias such pivotal motion so as to bias roller 18 against the ramp rail structure 30, described in more detail below.

A locking support structure 30, having a first rail surface 32 at an inclined angle to the access door panel 10, and a second rail surface 34 disposed substantially perpendicular to such access door panel 10, is rigidly secured to a non-moving door frame structure, such as passageway frame or portal 19, at a position such that when the door panel 10 is moving towards the closed position, the lever arm 12 will be biased towards such locking support structure 30, such that roller 18 will be biased against the inclined first rail surface 32 and caused to roll upward along the inclined first rail surface 32. In the presently preferred embodiment of the invention, the second rail surface 34, disposed substantially perpendicular to access door panel 10, intersects the first rail surface 32 at an angle of less than about 90° so that continued motion of roller 18 upward along the first rail surface 32 will eventually cause roller 18 to move past the point of intersection of the two rail surfaces 32 and 34, so that the biasing action keeping roller 18 against the first rail surface 32 will cause the roller 18 to be pivoted inward and adjacent the perpendicular second rail surface 34 as the door panel 10 reaches the fully closed position. Because the second rail surface 34 is perpendicular to door panel 10, and therefore perpendicular to the movement plane of access door panel 10, it will function as an abutment against roller 18, thereby blocking roller 18, and accordingly blocking the door panel 10 from being returned to the open position. While the point of intersection between the first and second rail surfaces 32 and 34 are shown as a sharp point of intersection where the two straight surfaces intersect, it should be apparent the curved surface transitioning from one flat surface 32 or 34 to the other could be provided as long as roller 18 will abut against at least a perpendicular portion of the second rail surface 34 when the access door panel 10 is fully closed to thereby maintain the door panel 10 in a locked position.

As should be apparent from the above description, the relative positions of locking lever arm 12 and locking support structure 30 must be selected such that as the access door panel 10 is approaching the closed position, roller 18 will be caused to roll upward along the inclined first rail surface 32, and when such door panel 10 reaches a fully closed position, roller 18 will be caused to be pivoted against the perpendicular second rail surface 34 thereby locking the door panel 10 in place so that it cannot be reopened by extraneous forces, such as vibration, wind, vehicle movement, and/or an unintended opening by a passenger.

Since the door panel 10 will have to be opened from time to time to permit passengers to ingress and egress to and from the vehicle, means must be provided to automatically unlock the above described locking apparatus when the door opening apparatus (not shown) is activated, and in addition, means must also be provided to permit manual unlocking of the apparatus in the event of an emergency situation developing.

Both of these critical functions are provided in the presently preferred embodiment, as illustrated in FIG. 1, by providing an unlatching lever assembly 40, which will unlatch the above described locking apparatus, and is automatically operated by an unlocking cylinder assembly 50, and in the alternative, can be manually operated by a manual unlocking assembly 60. Either the unlocking cylinder assembly 50 or the manual unlocking assembly 60 will activate the unlatching lever assembly 40 that will effectively push or lift roller 18 away from the perpendicular second rail surface 34 so that the access door panel 10 can be at least partially opened to a point where release of the pushing or lifting means will cause such roller 18 to engage the inclined first rail surface 32 which will not thereafter block the access door panel 10 from being moved to the fully open position.

While a great variation of such means are envisioned to be possible, one presently preferred apparatus for achieving this result is the unlatching lever assembly 40, as illustrated in FIG. 1, which includes a two piece lever arm, namely an activating lever arm or upper lever arm 42 and a lower unlatching arm 44, both of which are pivotally secured to unlatching support structure 30 by pin 46, such that an unlatch pin 48, which extends downwardly from the outward end of such lower unlatching arm 44, will be positioned adjacent the upper side of lever arm 12 when the access door panel 10 is in the fully closed position. In the embodiment shown, locking lever arm 12 is provided with an upwardly extending flange member 28 against which the unlatching pin 48 is forced, to thereby pivot lever arm 12, and accordingly pivot such roller 18, away from perpendicular second rail surface 34 to unlock the door panel 10.

Upper lever arm 42 and lower unlatching arm 44 are partially interlocked and are maintained in a fixed position by a torsion spring 49. The partial interlocking is such that counter-clockwise pivotal rotation of such upper lever arm 42 will cause the lower unlatching arm 44 to pivot or rotate through the same angle, but such that counter-clockwise pivotal rotation of lower unlatching arm 44 will not cause any motion of upper lever arm 42.

Methods for effecting such partial interlocking are well known in the mechanical art, and need not be described in significant detail here. For example, a rigid pin provided in one pivotal arm extending through an arcuate slot in the other pivotal arm is well known, as are other techniques.

Accordingly, a counter-clockwise turning action applied to the upper lever arm 42, causing it to pivot or rotate to the left (i.e., counter-clockwise as viewed from the top), will cause the lower unlatching arm 44 to rotate or pivot through the same angle of rotation. Such pivotal rotation of the lower unlatching arm 44 will cause the unlatching pin 48 to push against the upper edge of the locking lever arm 12, namely flange member 28, and thereby cause roller 18 to be moved outward and away from perpendicular second rail surface 34, so that such access door panel 10 can be opened.

An activating means such as the unlocking cylinder assembly 50 is provided for the purpose of automatically activating such unlatching lever assembly 40 as above-described. Specifically, unlocking cylinder assembly 50, comprises a hydraulic or pneumatic cylinder or even a solenoid 52, which activates reciprocating cylinder rod 54. The outward end of cylinder (or solenoid) reciprocating rod 52 is pivotally connected to upper lever arm 42 by pin 56. As previously noted, upper lever arm 42 and lower unlatching arm 44 are partially interlocked and are maintained in a fixed position by such torsion spring 49. Torsion spring 49 further serves to bias the lower unlatching arm 44 as necessary to position unlocking pin 48 into a neutral position so that the locking lever arm 12 and roller 18 can move as required to lock such access door panel 10 in place without obstruction. When the door opening apparatus (not shown) is activated, cylinder (or solenoid) 52 will automatically be activated to pull cylinder rod 54 and thereby rotate upper lever arm 42 in a counterclockwise direction. As lower unlatching arm 44 is mechanically interlocked for rotation in that direction, lower unlatching arm 44 will also be rotated so that unlatch pin 48 will push lever arm 12 aside, thereby pushing roller 18 away from perpendicular second rail surface 34 so that such access door panel 10 can be opened, as becomes necessary.

Figure 2:
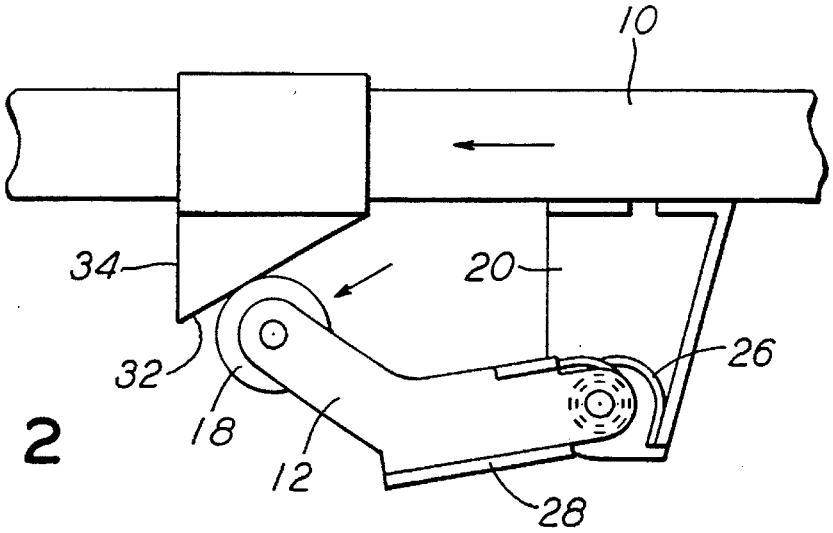
FIG. 2 is sectional plan view of the apparatus illustrated in FIG. 1 showing the access door panel in a position where it is moving towards a closed position.
Figure 3:
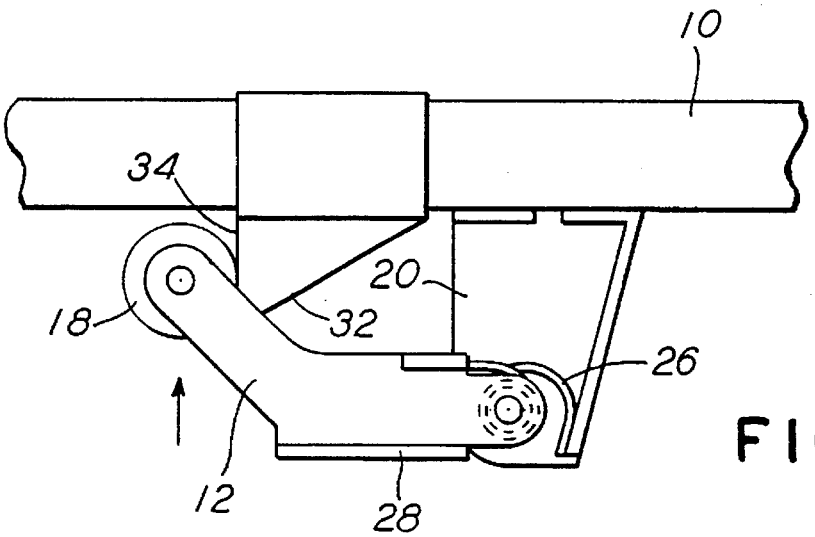
FIG. 3 is a sectional plan view substantially the same as that shown in FIG. 2 but showing the access door panel in a fully closed and locked position.
Figure 4:
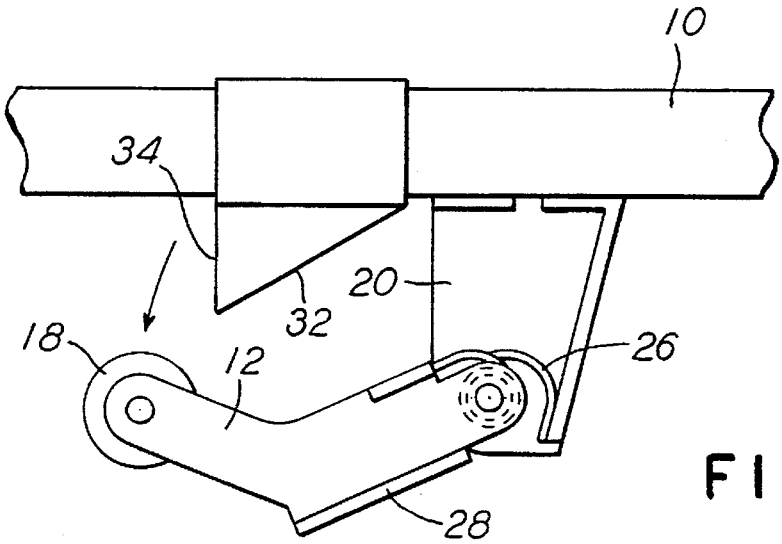
FIG. 4 is a sectional plan view substantially the same as that shown in FIG. 3 but showing the access door panel in a fully closed position after the locking apparatus has unlocked the door panel.

Reference is now made to FIG. 2 which illustrates the access door panel 10 as it is moving closely towards the fully closed position, with the roller 18 moving along the inclined first rail surface 32. FIG. 3 illustrates the arrangement of the apparatus when such access door panel 10 is in the fully closed position with the roller 18 abutted against such substantially perpendicular second rail surface 34 to lock the door panel 10 in such closed position. FIG. 3, on the other hand, further illustrates the arrangement of the apparatus after unlatching lever assembly 40 has been automatically activated, as above-described, to push the locking lever arm 12 and such roller 18 away from the two rail surfaces 32 and 34. While not shown in the drawings, this result is achieved by activation of cylinder 52 to pull reciprocating rod 54, thereby causing the lower unlatching arm 44 to be partially rotated, such that unlatching pin 48 is caused to move outward, pushing against the flange member 28 of locking lever arm 12 and causing roller 18 to be moved away from such perpendicular second rail surface 34. In this position, movement of access door panel 10 will not be blocked from motion towards the open position, and accordingly, the door opening apparatus will cause such access door panel 10 to be moved towards the open position, such that the door panel 10 will no longer be locked in place, but will instead be in a position substantially as shown in FIG. 2.

For manual unlocking of the access door panel 10, a manual activating means such as manual unlocking mechanism 60 is utilized to manually activate the, above-described, unlatching lever assembly 40. The manual unlocking mechanism 60 includes manually operated linkage which, in essence, does the same thing that unlocking cylinder assembly 50 does, and comprises a by-pass lever support structure 62, to which a by-pass lever 64 is pivotally mounted on a pin 66. One end of a push rod 68 is connected to the by-pass lever 64 by linkage 69, and the other end is inserted through an eyelet 70 at a position where it will abut against the lever portion of lower unlatching arm 44, such that a manual force on by-pass lever 64 (as indicted by the arrow), will result in a pushing action on push rod 68, and accordingly a rotation of such lower unlatching arm 44 as necessary to cause the roller 18 to be moved away from such substantially perpendicular second rail surface 34 and disengage the locking action as has been described above. Because the upper lever arm 42 and the lower unlatching arm 44 are only partially interlocked, such lower unlatching arm 44 can be rotated as described without also rotating upper lever arm 42, and accordingly without having to overcome the rigid fixation of the upper lever arm 42 and the cylinder rod 54.

As is illustrated in FIG. 1, a cable 80, extending through an eyelet 82 can be attached to the end of such lower unlatching arm 44 opposite push rod 68, to provide an alternate method for manual activation of unlatching lever assembly 40. A pulling force on cable 80 will cause the lower unlatching arm 44 to pivot and unlatch the locking action as described above.

Figure 5:
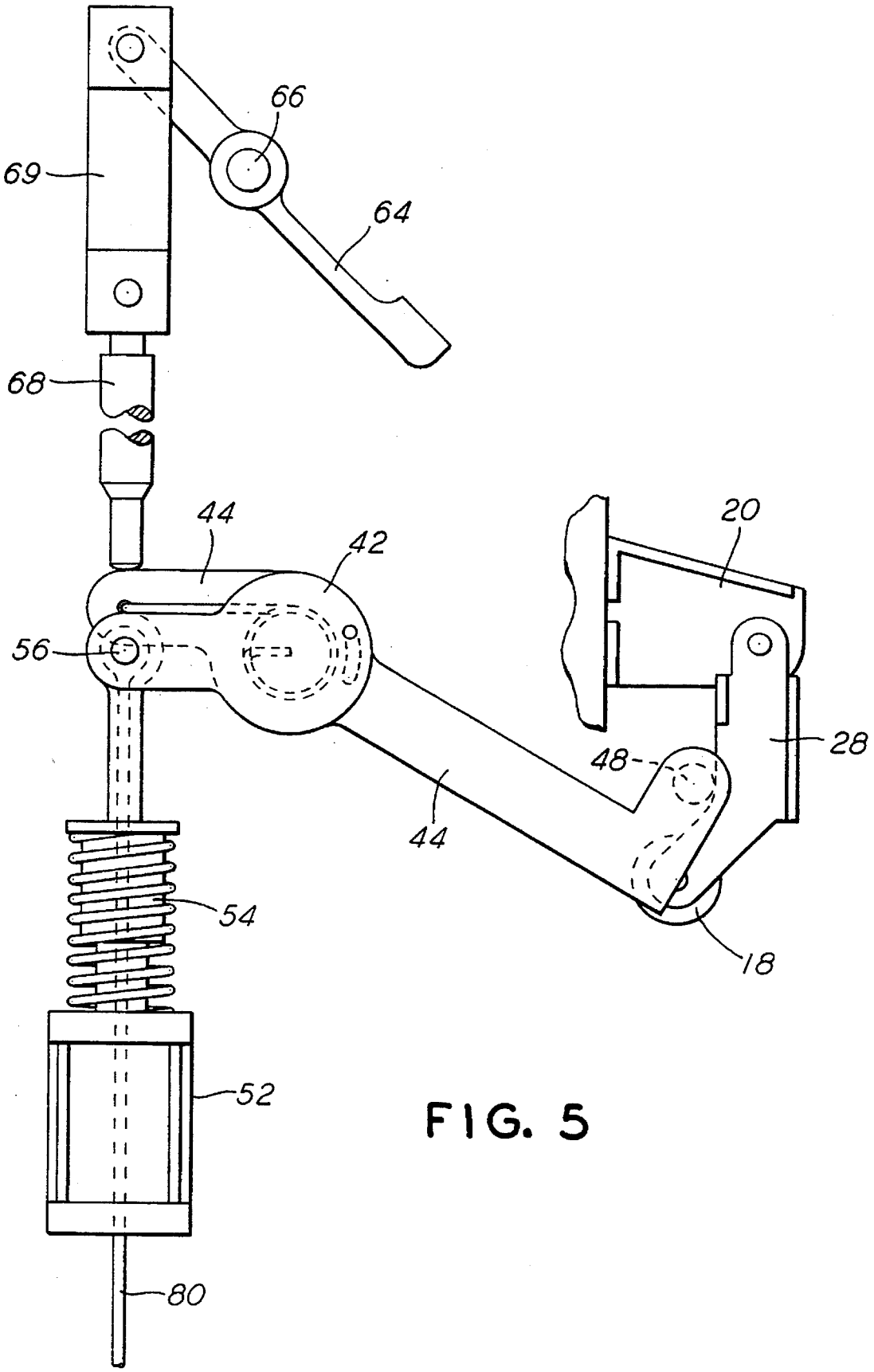
FIG. 5 is a plan view of the unlatching apparatus shown in FIG. 1, with the components in a normal position.
Figure 6:
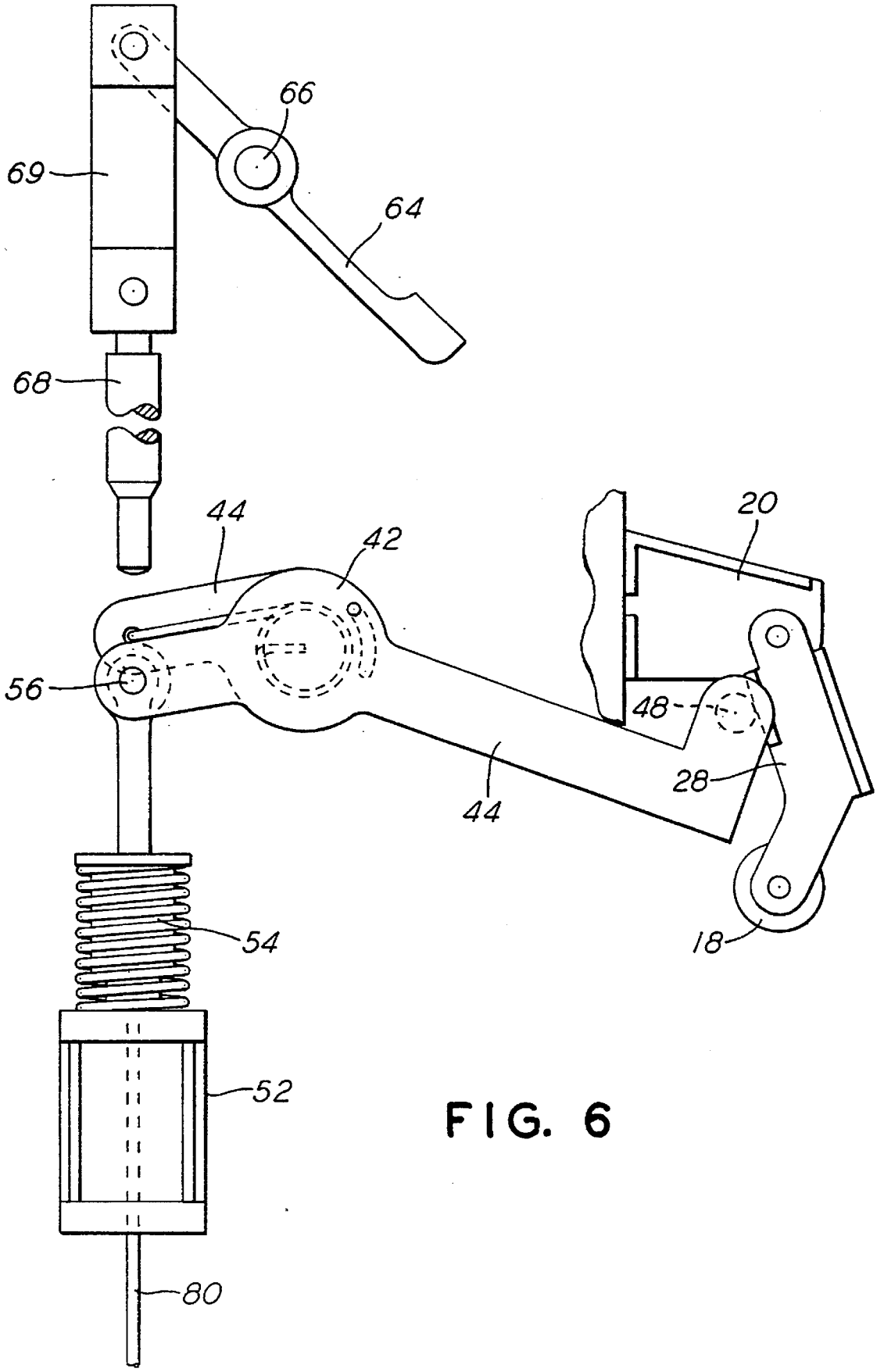
FIG. 6 is identical to FIG. 5 except that the components are shown as positioned in response to automatic door opening.
Figure 7:
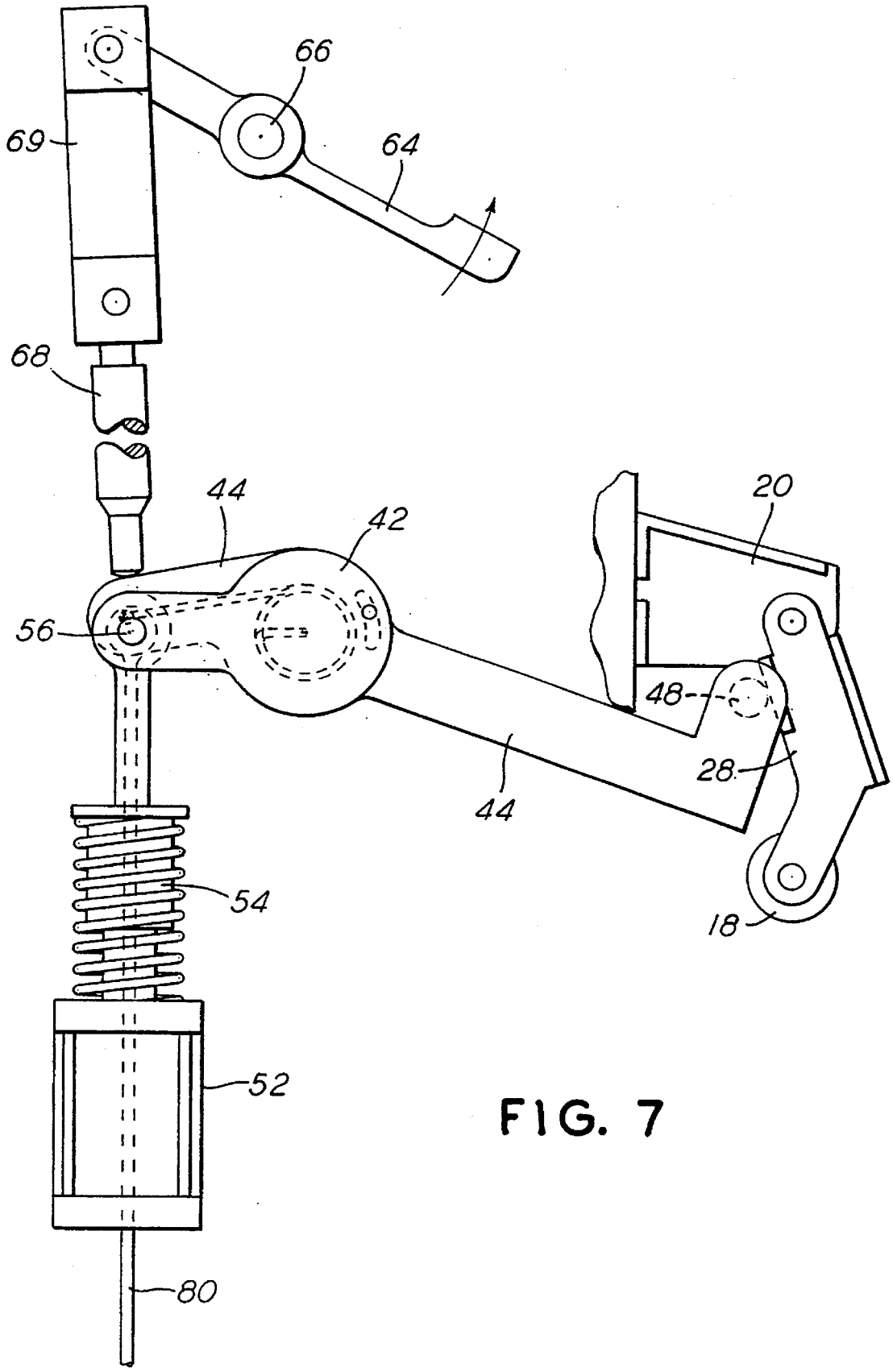
FIG. 7 is identical to FIG. 5 except that the components are shown as positioned in response to manual door opening.

While a preferred embodiment of the mechanical door locking apparatus of the present invention has been described in detail above, it should be apparent to those persons skilled in the art that various other embodiments, adaptations and modifications of the invention could be made without departing from the spirit and scope of the invention. Reference to FIGS. 5, 6 and 7, will illustrates the above described operation of the automatic and manual pivotal action of the unlatching arm 44, with FIG. 5 illustrating the components in the neutral position, FIG. 6 illustrating the components upon automatic unlocking, and FIG. 7 illustrating the components upon manual unlocking. For purpose of simplifying the drawings, certain non-functioning elements have omitted from the drawings, such as eyelets 70 and 82.

For example, while the above described embodiment is described as utilized in combination with a single access door panel of the sliding type, it should be apparent that the inventive apparatus could be adapted for use on other types of door panels, including double door panels and even folding single and double door panels. For example, for use with double door panels, the locking lever arm 12 could be secured to one door panel as described above, with the locking support structure 30 secured to the other door panel. But for the fact that both elements will be moving elements and positioned so that they will move towards each other as the doors move towards the closed position, the locking mechanism would operate virtually the same. Positioning variations may have to be made depending upon whether the door panels abut or overlap each other. It should be readily apparent, a similar locking apparatus could be designed for folding door panels as well, as the outer edge of a folding single door panel, or outer edges of double folding door panels move generally horizontally as they approach a fully closed position, and could therefore, be locked in substantially the same way with substantially similar apparatus.

While the above described locking apparatus describes a pivotal motion of locking lever arm 12 towards the door panel 10, is should be readily apparent that the reverse pivotal motion could be utilized by merely positioning the locking support structure 30 on a door frame structure displaced inwardly from the access door panel 10. As should also be obvious, the relative positions of the locking lever arm 12 and the locking support structure 30 could be reversed if so desired so that the locking support structure 30 is virtually pushed under locking lever arm 12 as the door panel is closing, with virtually identical locking results.

With regard to the automatic and manual unlocking apparatus described, is should be quite apparent that the apparatus described is but one of a significant number of variations that could be devised and designed, as the only requirement be that some means be provided to displace the roller 18 from the perpendicular second rail surface 34 until the access door panel 10 starts to open. It should be quite apparent that a great number of different devices could be designed to accomplish this purpose, which could even include a spring loaded ramp rail structure that can be retracted inwardly like a conventional door latch, away from the roller 18 to unlatch the lock.

While the manual unlocking apparatus described functions to manually unlock the door panel utilizing the same apparatus utilized by the automatic unlocking system, it should be apparent that an entirely different systems could be utilized for the automatic and manual unlocking apparatus. Clearly, therefore, other variations, embodiments, adaptations and modifications could be made without departing from the spirit and scope of the present invention, as defined by the appending claims.

I claim:

1. An apparatus for mechanically locking and unlocking a passenger access door panel on a railway vehicle, said apparatus comprising:

(a) a movable door panel disposed in a generally vertical plane and adapted for opening and closing movement in a generally horizontal plane of movement;

(b) a locking lever arm having a first end pivotally secured to a first of said movable door panel and a structure adjacent said movable door panel, and having a roller rotatably secured to a second end, said locking lever arm pivotally secured such that pivotal movement of said locking lever arm will cause said roller to move in an arc generally perpendicular to said horizontal plane of movement;

(c) a biasing means to pivotally bias said locking lever arm about said first end, such that said roller is biased in a biasing direction generally perpendicular to said horizontal plane of movement;

(d) a locking support structure secured to a second of said movable door panel and said structure adjacent said movable door panel, said locking support structure having a first rail surface portion at least a part of which is at an inclined angle to said horizontal plane of movement, and a second rail surface portion substantially perpendicular to said horizontal plane of movement, such that said first and second rail surface portions intersect and form a rail surface intersection; the relative positions of said locking lever arm and said locking support structure being such that when said door panel is moved towards a closed position, said roller on said locking lever arm is caused to engage and roll along said first rail surface portion towards said rail surface intersection, and such that when said roller is rolling along said part of said first rail surface portion that is at an inclined angle to said horizontal plane of movement, said locking lever arm is caused to be pivoted in a direction opposite to said biasing direction caused by said biasing means, and such that when said door panel reaches a fully closed position, said roller will have rolled beyond said rail surface intersection, so that said locking lever arm is biased by said biasing means sufficient to pivot said roller to a position adjacent to said second rail surface portion to thereby lock said door panel in said fully closed position;

(e) means for automatically pivoting said locking lever arm in a direction opposite to said biasing direction of said biasing means and away from said locking support structure to thereby unlock said door panel; and (f) means for manually pivoting said locking lever arm in a direction opposite to said biasing direction of said biasing means and away from said locking support structure to thereby unlock said door panel.

2. An apparatus for mechanically locking and unlocking a passenger access door panel on a railway vehicle, according to claim 1, wherein said means for automatically pivoting said locking lever arm in a direction opposite to said biasing direction, is automatically activated in response to a door opening mechanism.

3. An apparatus for mechanically locking and unlocking a passenger access door panel on a railway vehicle, according to claim 2, wherein said means for manually pivoting said locking lever arm in a direction opposite to said biasing direction, comprises a manual means for operating said means for automatically pivoting said locking lever arm.

4. An apparatus for mechanically locking and unlocking a passenger access door panel on a railway vehicle, according to claim 1, wherein said movable door panel is a single sliding door panel.

5. An apparatus for mechanically locking and unlocking a passenger access door panel on a railway vehicle, according to claim 1, wherein said movable door panel is a single folding door.

6. An apparatus for mechanically locking and unlocking a passenger access door panel on a railway vehicle, according to claim 1, wherein said movable door panel is one of a pair of a movable door panels and said structure adjacent said movable door panel is another of said pair of movable door panels.

7. An apparatus for mechanically locking and unlocking a passenger access door panel on a railway vehicle, according to claim 1, wherein said first rail surface portion and said second rail surface portion are elongated flat surfaces which intersect to form a angle of less than about 90°.

8. An apparatus for mechanically locking and unlocking a passenger access door panel on a railway vehicle, according to claim 1, wherein said means for automatically pivoting said locking lever arm in a direction opposite to said biasing direction includes a pivotally mounted unlatching arm adapted to be pivoted against said locking lever arm and pivotally move said roller away from said locking support structure to an extent sufficient to permit said door panel to be moved towards an open position, and upon subsequent release of said pivotally mounted unlatching arm, said roller will be caused to engage said first rail surface portion of said locking support structure so that said door panel can be moved to a fully open position.

9. An apparatus for mechanically locking and unlocking a passenger access door panel on a railway vehicle, according to claim 8, wherein said unlatching arm includes an unlatching pin thereon adapted to engage and pivot said second end of said locking lever arm away from said second rail surface portion when said unlatching arm is activated.

10. An apparatus for mechanically locking and unlocking a passenger access door panel on a railway vehicle, according to claim 9, wherein said locking lever arm is provided with a flange adapted to be engaged by said unlatching pin.

11. An apparatus for mechanically locking and unlocking a passenger access door panel on a railway vehicle, according to claim 10, wherein said unlatching arm is partially interlocked to an activating lever arm such that pivotal rotation of said activating lever arm in one rotational direction will cause pivotal rotation of said unlatching arm as necessary to pivot said second end of said locking lever arm away from said second rail surface portion, and such that said unlatching arm can be pivoted as necessary to pivot said second end of said locking lever arm away from said rail surface portion without causing any pivotal rotation of said activating lever arm.

12. An apparatus for mechanically locking and unlocking a passenger access door panel on a railway vehicle, according to claim 11, including a reciprocating drive means to activate said activating lever arm.

13. An apparatus for mechanically locking and unlocking a passenger access door panel on a railway vehicle, according to claim 12, wherein said reciprocating drive means is selected from the group consisting essentially of a hydraulic cylinder, a pneumatic cylinder and a solenoid.

14. An apparatus for mechanically locking and unlocking a passenger access door panel on a railway vehicle, according to claim 12, wherein said roller is rotatably secured to said second end of said locking lever arm with a pin, and said biasing means comprises a torsion spring disposed around said pin.

* * * * *

UNITED STATES PATENT AND TRADEMARK OFFICE

CERTIFICATE OF CORRECTION

PATENT NO. : 5,456,504
DATED : October 10, 1995
INVENTOR(S) : Daniel Brillant

It is certified that error appears in the above-indentified patent and that said Letters Patent is hereby corrected as shown below:

Column 2, line 23, delete the hyphen.

Column 3, line 1, delete the comma.

Column 6, line 34, delete "counterclockwise" and insert --counter-clockwise--.

Signed and Sealed this

Twenty-third Day of January, 1996

*Attest:*

Bruce Lehman

BRUCE LEHMAN

*Attesting Officer*

*Commissioner of Patents and Trademarks*